United States Patent [19]

Griffin et al.

[11] 3,991,432

[45] Nov. 16, 1976

[54] DUST MOP WITH PEEL-OFF MOP HEAD

[76] Inventors: Dana K. Griffin, 24714 Madison Court, Apt. 296, Farmington, Mich. 48024; John R. Wilson, 3203 E. Bradford Drive, Birmingham, Mich. 48010

[22] Filed: Feb. 26, 1975

[21] Appl. No.: 553,239

[52] U.S. Cl. ..... 15/229 BP

[51] Int. Cl.[2] ..... A47L 13/252

[58] Field of Search ..... 15/147 R, 147 A, 149, 15/227, 228, 229 R, 229 A, 229 AC, 229 AP, 229 B, 229 BC, 229 BP; 401/18, 24, 203, 204

[56] References Cited

UNITED STATES PATENTS

| | | | |
|---|---|---|---|
| 2,655,680 | 10/1953 | Geerin | 15/228 |
| 2,738,533 | 3/1956 | Peterson | 15/229 AP X |
| 3,166,775 | 1/1965 | Cushman | 15/228 |
| 3,295,155 | 1/1967 | Belsky et al. | 15/228 X |
| 3,412,418 | 11/1968 | Griffin | 15/229 A |
| 3,528,120 | 9/1970 | Lindstrom | 15/228 |
| 3,593,359 | 7/1971 | Strauss | 15/229 BP |
| 3,737,938 | 6/1973 | Saltzstein | 15/231 |
| 3,822,435 | 7/1974 | Moss | 15/229 BP |

FOREIGN PATENTS OR APPLICATIONS

| | | | |
|---|---|---|---|
| 770,987 | 7/1934 | France | 15/229 BP |
| 806,694 | 9/1936 | France | 15/227 |
| 6,708,504 | 12/1968 | Netherlands | 15/228 |

*Primary Examiner*—Daniel Blum
*Attorney, Agent, or Firm*—Robert G. Mentag

[57] ABSTRACT

A dust mop provided with a mop head frame which has means for attachment of the frame to a mop handle. A frame cover is mounted around about the mop head frame for encasing the same. A mop head is provided which includes a mop element on the lower side thereof and a fiber cloth backing material on the upper side thereof. A releasable hook fastening means is carried on the bottom side of the frame cover for releasably attaching the frame cover to the mop head.

1 Claim, 4 Drawing Figures

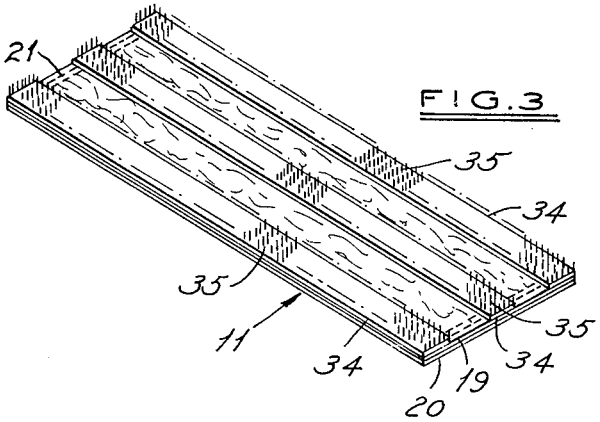
FIG. 3
FIG. 4
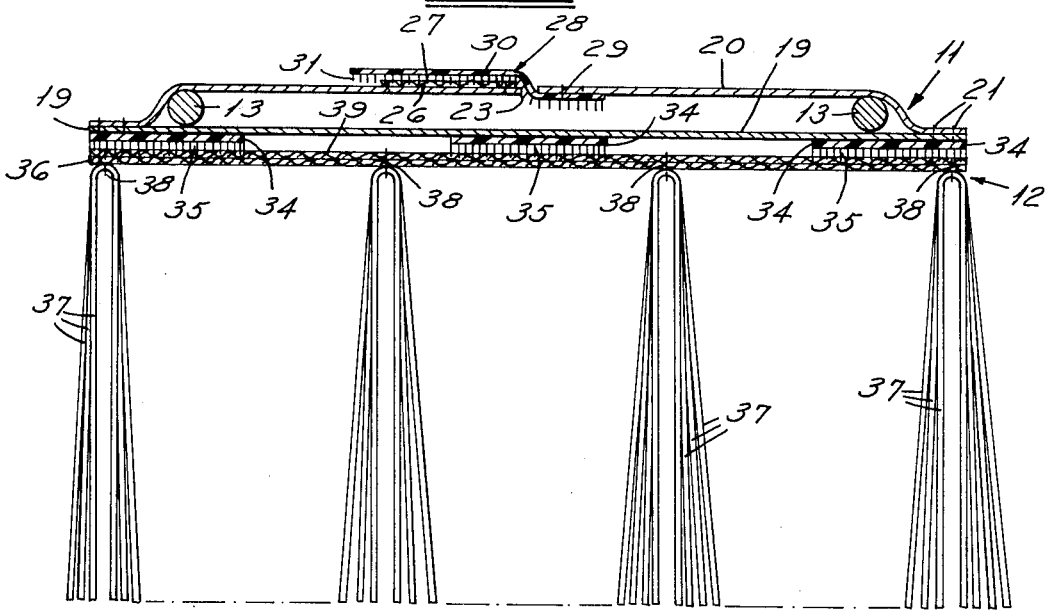

DUST MOP WITH PEEL-OFF MOP HEAD

SUMMARY OF THE INVENTION

This invention relates to the dust mop art, and more particularly, to an improved dust mop having a releasably attached mop head.

The prior art dust mops have many disadvantages. For example, in the prior art dust mops the handle carrier frame is usually mounted in a pocket formed by a flexible cloth material on the top of the mop head. The attaching of the handle carrier frame to a mop head in the aforementioned manner is time-consuming and must be carried out each time a mop head is replaced. Mop heads formed with said pockets built on the upper side thereof have the disadvantage of costing more to make than dust mops without such a pocket, since the forming of the frame pocket on a mop head comprises a significant part of the labor and material for forming the mop head. Another disadvantage of such prior art dust mops is that if the frame pocket is too big, the frame slides around in the pocket; and if the frame pocket is too small, as a result of original manufacture or laundering of the mop head, then it is difficult to insert the carrier frame in the pocket.

In view of the foregoing, it is an important object of the present invention to provide an improved mop structure that overcomes the aforementioned disadvantages of the prior art dust mops.

It is another object of the present invention to provide an improved dust mop structure wherein the mop head may be quickly and easily attached to a frame cover by pressing the frame cover onto the mop head, and wherein the mop head may be quickly and easily peeled from the frame cover.

It is still another object of the present invention to provide an improved dust mop structure which is compact and simple in construction, light in weight, economical to manufacture and efficient in use.

It is still a further object of the present invention to provide an improved dust mop structure that comprises a mop head frame which includes means for attachment of the frame to a mop handle, a frame cover encasing said mop head frame, a mop head including a mop element on the lower side thereof and a fiber cloth backing material on the upper side thereof, and releasable fastening means for releasably attaching said frame cover to said mop head. The releasable fastening means is preferably a releasable hook means of the "VELCRO" fastening type means. The frame cover is preferably made from a nonstretching flexible plastic material.

Other objects, features and advantages of this invention will be apparent from the following detailed description, appended claims, and the accompanying drawings.

BRIEF DESCRIPTION OF THE DRAWINGS

FIG. 3 is a perspective bottom view of the frame cover of the dust mop of the present invention.

FIG. 4 is an enlarged, elevational, section view of the dust mop structure illustrated in FIG. 1, taken along the line 4—4 thereof, and looking in the direction of the arrows.

DESCRIPTION OF THE PREFERRED EMBODIMENT

Figure 2:
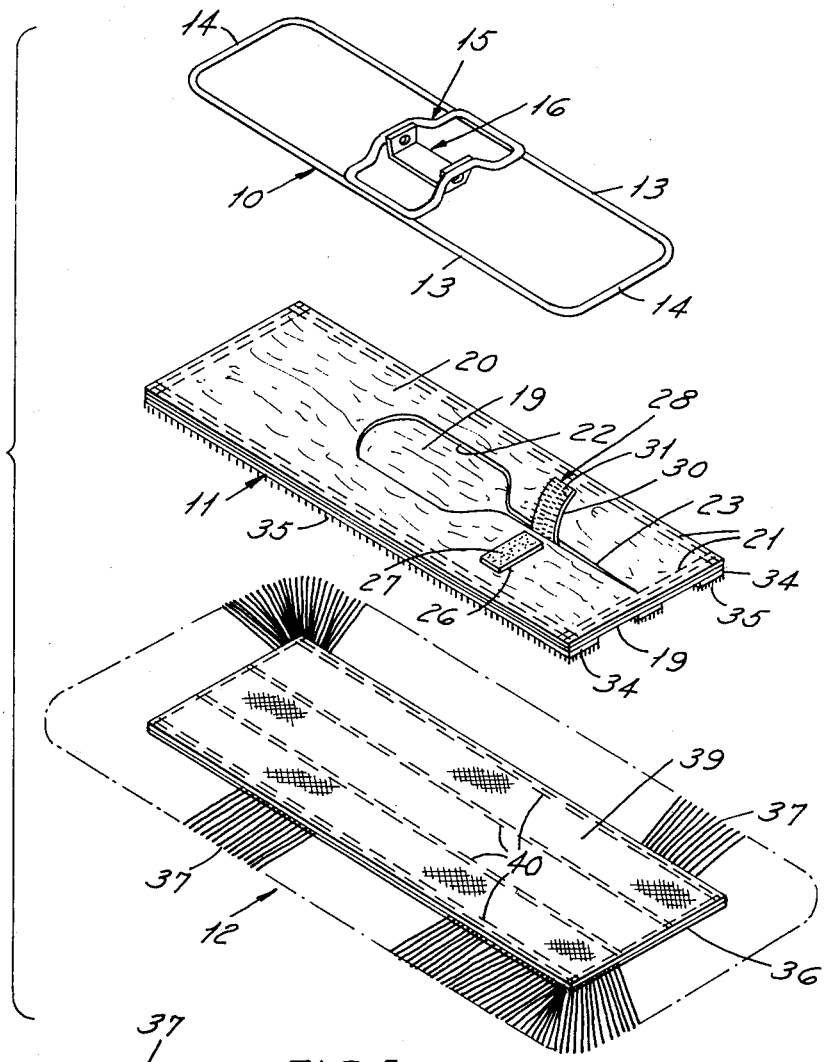
FIG. 2 is an exploded view showing the various parts of the dust mop of the present invention in the order in which they are assembled together.
Figure 1:
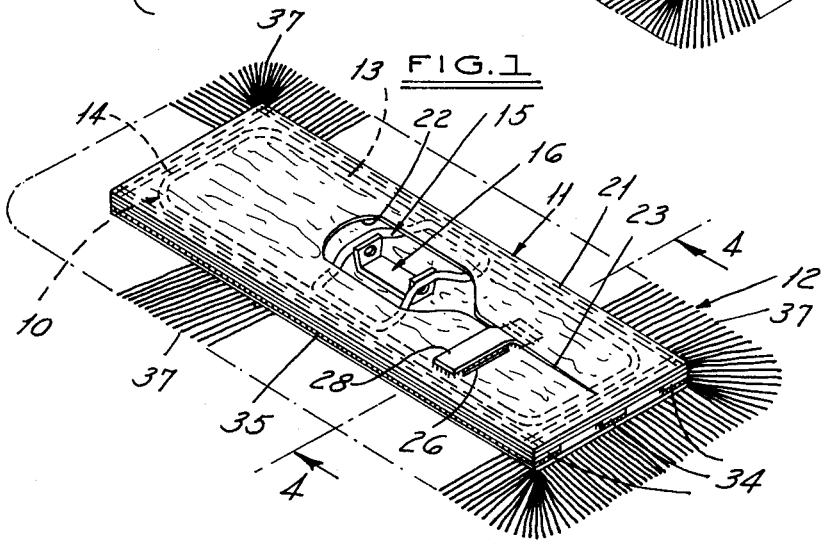
FIG. 1 is a perspective top view of a dust mop made in accordance with the principles of the present invention.

Referring now to the drawings, and in particular to FIGS. 1 and 2, wherein is shown an illustrative embodiment of the invention, the numeral 10 generally designates a conventional dust mop supporting and handle attachment frame. The handle attachment frame 10 is carried in a supporting frame cover, generally indicated by the numeral 11, which is releasably secured, as described in detail hereinafter, to a dust mop head generally indicated by the numeral 12.

As shown in FIG. 2, the dust mop frame 10 includes a pair of elongated, spaced apart parallel metal end rods 13 which are joined at the side ends thereof by a pair of integral parallel metal side rods 14 to provide a rectangular frame. The supporting frame 10 further includes a conventional mop handle attachment bracket, generally indicated by the numeral 15, which is substantially rectangular in plan shape. The handle attachment bracket 15 has its shorter side ends attached to the frame end rods 13 by any suitable means, as by welding. The center portion of the longer sides of the handle attachment bracket 15 are extended upwardly and they have attached thereto the vertical leg portions of a handle attachment channel member 16. The leg portions of the channel member 16 have suitable apertures therein for the reception of the attachment pivot pins of a conventional dust mop handle.

As shown in FIGS. 1 and 4, the supporting frame 10 is mounted in the frame cover 11 which comprises a lower rectangular panel 19 and an upper rectangular panel 20. The frame cover panels 19 and 20 can be made from any suitable material, but preferably, they are made from a nonstretching plastic material, as, for example, the type of plastic seat material employed in the making of the seats for automobiles, furniture and the like. As shown in FIG. 2, the frame cover panels 19 and 20 are secured together along the outer edges thereof by any suitable means, as, for example, by suitable stitching 21.

As shown in FIGS. 1 and 2, the upper frame cover panel 20 is provided with a centrally disposed, elongated rectangular opening, indicated by the numeral 22, through which protrudes the upwardly extended portion of the channel 16 of the handle attachment bracket 15 to permit a conventional mop handle to be attached to the bracket 15. The frame cover panel 20 is further provided with an elongated slot 23 which extends from one end of the panel 20 longitudinally inward to communicate with one end of the elongated and substantially rectangular opening 22, so as to permit the mop supporting frame 10 to be inserted through the opening 22 and the slot 23 into the frame cover 11, as shown in FIG. 1.

As shown in FIGS. 1, 3 and 4, the frame cover 11 is provided with an attachment strap, generally indicated by the numeral 28, for holding the portions of the top panel 20 together adjacent the slot 23. As best seen in FIG. 4, the attachment strap 28 comprises an elongated, rectangular piece of "VELCRO" type fastening material. The attachment strap 28 includes an inner portion 29 which is attached to the underside of the panel 20, adjacent one side of the slot 23 by a suitable adhesive or stitching. The attachment strap 28 includes an outer portion 30 which is extended upwardly through the slot 23 so as to overlie the top panel 20, transversely of the other side of the slot 23. A rectangular attachment strap 26 is attached by any suitable means, as by an adhesive or suitable stitching, to the top side of the panel 20 in a position to underlie the overlapping portion 30 of the attachment strap 28. As shown in FIGS. 2 and 4, the underside of the attachment strap 28 is provided with what may be termed the hook portion or the male portion of a "VELCRO" type fastening material, indicated by the numeral 31, which engages and is secured to a female or woven "VELCRO" type fastening material, indicated by the numeral 27. When the strap 28 is pressed downwardly, as shown in FIGS. 1 and 4, the attachment straps 28 and 26 are releasably secured together to retain the support frame 10 in the frame cover 11.

It will be understood that the "VELCRO" type fastening means is a zipper type fastening means which is available on the market from the American Velcro, Inc., of Manchester, N.H., and sold under the trademark "VELCRO." It will be understood that other suitable fastening means may be used to releasably fasten the attachment strip 28 to the attachment strip 26, as for example, a conventional snap fastener means.

As best seen in FIGS. 3 and 4, the frame cover 11 is provided on the lower face thereof with a releasable fastening means comprising a plurality of elongated strips 34 that are disposed longitudinally in laterally spaced positions. As best seen in FIG. 3, three of the strips 34 are fixedly mounted to the lower face of the frame cover lower panel 19 by any suitable means, as by a suitable adhesive or by sewing, or a combination of an adhesive and sewing. The lower side of each of the strips 34 is provided with "VELCRO" hook fastening means, indicated by the numeral 35.

As shown in FIGS. 1, 2 and 4, the mop head 12 is a conventional mop head including a lower rectangular piece of material 36 which may be made of any suitable material, as for example, canvas. The mop head includes the usual strands of dusting yarn 37.

The yarn 37 may be tufted into the piece of canvas 36 or secured thereto by suitable stitching 38. The mop head 12 further includes an upper rectangular piece of material 39 which is secured to the lower piece of canvas material 36 by any suitable means, as by stitching 38 which is also employed to hold the strands of dusting yarn 37 to the mop head piece of canvas 36. The upper piece of material 39 provides a backing material for the mop head 12. The upper mop head piece 39 is made from a suitable woven or nonwoven cloth or tufted yarn. The piece of backing material 39 must be of a nature so that it has fibres which are in a position to catch and hold the "VELCRO" hooks 35 on the lower face of the fastening means strips 34.

In use, the mop head 11 is laid on the floor with the backing material 39 facing upwardly. The operator then moves the mop handle carrying the frame cover 11 with the frame 10 therein over the mop head 12 and into a position in vertical alignment therewith. The frame cover 11 with the frame 10 inside thereof is then moved downwardly into engagement with the mop head 11, and a downward pressure is exerted so as to engage the "VELCRO" hooks 35 with the material of the mop head backing piece 39. The mop may be used in the usual way, and when it is necessary to replace the mop head 12, the operator grasps one end of the mop head 12 and peels it off the lower side of the frame cover 11, whereby a clean mop head 12 may be quickly and easily mounted on the frame cover 11 in the aforedescribed manner.

It will be understood that the mop head elements 36, 37 and 39 may be made from any suitable washable materials, or from low-cost throwaway materials, so that the dirty mop heads 12 may be thrown away without the need for cleaning the same.

The prior art dust mops have the frame pocket built into the top of the dust mop head 12, as shown in U.S. Pat. No. 3,711,885. The building of the frame pocket into a dust mop head includes a significant part of the labor cost that goes into the making of a dust mop head. An advantage of the present invention is that it eliminates the need for a frame pocket built into the dust mop head, and the frame cover 11 which carries the frame 10 may be reused with a replaceable low-cost dust mop head 12.

A problem of the prior art mop head shown in U.S. Pat. No. 3,711,885 is that the handle frame slides around in the pocket in the flexible material from which the mop head is made, and such sliding creates problems in the use of the mop head. A further problem of the prior art dust mops is that the frame pocket is sometimes too small for the handle frame, and it is a cause of constant complaints of users to the dust mop makers, that the smallness of the pocket has been created in many cases by the relaundering of mop heads that may be cleaned and reused. The dust mop of the present invention overcomes the problems created by having the handle frame pocket formed in the dust mop head.

A further advantage of the present invention is that it also provides for the standardization of the width of dust mop heads. At the present time, there are available on the market three common widths of dust mops; namely, 3 inches, 3⅝ and 5 inches. By making the frame cover 11 and frame 10 to a size to accommodate a 5 inches wide dust mop head, the frame cover 11 may be used for all three sizes of dust mops, if desired. It will be understood that the "VELCRO" fastening means strips 34 may be mounted as a plurality of transverse strips on the underside of the frame cover 11. However, it is more advantageous to dispose the strips 34 longitudinally, as shown in FIG. 3, so as to eliminate any gaps lengthwise of the dust mop head 12 which would occur with the fastening strips 34 disposed transversely. It is also harder to peel off the mop head 12 from the frame cover 11 when the strips 34 are disposed transversely of the mop head lower piece 19.

The structure of the dust mop of the present invention provides a better dusting action over the surface of a floor because the downward pressure exerted by the mop handle is transferred against the entire dust mop head rather than around the frame edges only as in the prior art dust mops.

While it will be apparent that the preferred embodiment of the invention herein disclosed is well calculated to fulfill the objects above stated, it will be apparent that the invention is susceptible to modification, variation and change.

What is claimed is:

1. In a dust mop having a mop handle, the combination comprising:

a. a rectangular mop head frame, including a pair of elongated, spaced apart parallel end rods which are joined at the side ends thereof by a pair of integral parallel side rods, including means for attachment of the frame to a mop handle;

b. a frame cover encasing said mop head frame;

c. a mop head, including strands of yarn on the lower side thereof, and a backing material on the upper side thereof;

d. releasable fastening means for releasably attaching said frame cover to said mop head;

e. said frame cover is made from a nonstretching, flexible plastic material;

f. said backing material on the upper side of said mop head comprises a woven cloth backing material substantially the same size as the cover;

g. said releasable fastening means includes a releasable hook means carried on said frame cover for releasably attaching said frame cover to said woven cloth backing material on said mop head; and, h. said releasable fastening means includes a plurality of strip members secured to the lower side of said frame cover, and wherein said strip members have operatively mounted on the lower side thereof. a multiplicity of hooks in hooking engagement with the woven cloth.

* * * * *